US007210204B2

(12) United States Patent
Groemminger et al.

(10) Patent No.: US 7,210,204 B2
(45) Date of Patent: May 1, 2007

(54) PERSONALIZED CASKET ORNAMENT DISPLAY PLAQUE

(75) Inventors: Brian K. Groemminger, Batesville, IN (US); Christopher M. Wessel, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 9 days.

(21) Appl. No.: 11/110,548

(22) Filed: Apr. 20, 2005

(65) Prior Publication Data

US 2005/0183252 A1 Aug. 25, 2005

Related U.S. Application Data

(63) Continuation of application No. 10/427,299, filed on May 1, 2003, now Pat. No. 6,883,212, which is a continuation of application No. 09/972,464, filed on Oct. 5, 2001, now Pat. No. 6,557,222.

(51) Int. Cl.
*A61G 17/00* (2006.01)

(52) U.S. Cl. ..... 27/10; 27/1; 428/913.3; 40/124.5

(58) Field of Classification Search ..... 27/10, 27/1, 19, 2; 40/124.5; 428/913.3, 542.4
See application file for complete search history.

(56) References Cited

U.S. PATENT DOCUMENTS

| | | | | |
|---|---|---|---|---|
| 422,084 | A | 2/1890 | Learman | 40/124.5 |
| 1,755,784 | A | 9/1930 | Peters | |
| 3,025,624 | A | 3/1962 | Harrell | 40/124.5 |
| 3,865,342 | A | 2/1975 | Kanzelberger | 248/470 |
| 4,190,691 | A | 2/1980 | Kramer | 426/67 |
| 4,455,772 | A | 6/1984 | Miller | 40/124.5 |
| 4,457,054 | A | 7/1984 | Craft et al. | 27/1 |
| 4,571,790 | A | 2/1986 | James, III | 27/10 |
| 4,879,145 | A | 11/1989 | McLellan | 428/14 |
| 5,007,148 | A | 4/1991 | Bida | 27/1 |
| 5,584,135 | A | 12/1996 | Hosker | 40/800 |
| 5,678,289 | A | 10/1997 | Saaf | 27/2 |
| 5,695,066 | A | 12/1997 | Bartlett | 206/575 |
| 5,704,103 | A | 1/1998 | Crowley et al. | 27/1 |
| D390,321 | S | 2/1998 | Maple et al. | D99/13 |
| 5,813,098 | A | 9/1998 | Stewart | 27/2 |
| 5,896,632 | A | 4/1999 | Sturino | 27/1 |
| 5,987,720 | A | 11/1999 | Yamamoto | 27/35 |
| D418,961 | S | 1/2000 | Biondo et al. | D99/3 |
| 6,138,335 | A | 10/2000 | Drawbaugh et al. | 27/10 |

(Continued)

*Primary Examiner*—William L. Miller
(74) *Attorney, Agent, or Firm*—Wood, Herron & Evans, L.L.P.

(57) ABSTRACT

A casket ornament display plaque and associated methods for memorializing a deceased individual. The casket ornament display plaque comprises a decorative board, a casket ornament attached to the board, and indicia attached to the board identifying a deceased to be memorialized. The casket ornament is one having been removed from a casket in which the deceased was displayed. The indicia may be a nameplate bearing the name of the deceased, a photograph of the deceased, or both. A method for memorializing a deceased comprises displaying a casket containing the deceased therein, the casket having at least one selectively removable ornament, removing the ornament from the casket, affixing the ornament to a display plaque and presenting the display plaque and ornament to survivors of the deceased so that the deceased can be remembered by displaying the plaque and ornament.

23 Claims, 3 Drawing Sheets

U.S. PATENT DOCUMENTS

D433,585 S 11/2000 Bowers et al.
6,237,202 B1 5/2001 Agee et al. ..... 27/14
6,317,945 B1 11/2001 Laphan et al. ..... 27/10
6,543,103 B1 * 4/2003 Robert ..... 27/10
6,735,831 B1 * 5/2004 Greiwe et al. ..... 27/1

* cited by examiner

PERSONALIZED CASKET ORNAMENT DISPLAY PLAQUE

The instant application is continuation of application Ser. No. 10/427,299 filed on May 1, 2003, now U.S. Pat. No. 6,883,212, which is a continuation of application Ser. No. 09/972,464 filed on Oct. 5, 2001, now U.S. Pat. No. 6,557, 222.

FIELD OF THE INVENTION

The present invention generally relates to apparatus and methods for memorializing a deceased individual and, more specifically, to apparatus and methods for providing the survivors of the deceased a personalized keepsake after the deceased is buried or cremated.

BACKGROUND OF THE INVENTION

When an individual passes away it is customary for the body of the individual to be viewed by family and friends at a funeral home. After the viewing, a memorial service or funeral is generally held at the funeral home or a church to commemorate the life of the deceased. Thereafter, a grave side service may be held with family and friends looking on. With the completion of the grave side service the casket is lowered into the grave where it will remain. A similar service may be held prior to or after the deceased is cremated. Usually after cremation the cremated remains are collected and presented to the family in a cremation urn.

The casket in which the deceased is displayed can be customized to fit the needs and preferences of the deceased and the family. For instance, a wide variety of materials, finishes, colors and decorative ornamentation can be chosen to meet these needs. The purchaser of a casket can also customize the casket using a variety of interchangeable stylized trim, for example, or corner pieces. The purchaser may select from a number of stylized corner pieces each of which has been ornamented to represent a "theme." The purchaser thus selects a corner piece design having a theme representative of an aspect of the deceased's life to personalize the casket, for example, a golf corner piece design could be selected for installation on the casket to reflect that the deceased was an avid golfer.

Once the casket is buried or the deceased is cremated and the funeral services are completed, the families are left with few tangible reminders of the funeral and memorial services. Most families receive flowers at the funeral home which pay respect to the deceased and his or her surviving family. These flowers, however, wilt and die after a short time, leaving the family with few remembrances of the funeral or other memorial services. It is desirable for the families to receive a more tangible and permanent reminder of the funeral or memorial services.

SUMMARY OF THE INVENTION

In accordance with the principles of the present invention, a casket ornament display plaque comprises a decorative board, a casket ornament attached to the board, and indicia attached to the board identifying a deceased to be memorialized. The casket ornament is one having been removed from a casket in which the deceased was displayed.

The indicia may be a nameplate bearing the name of the deceased, a photograph of the deceased, or both.

The board may include a pair of dowels installed in openings in a rear side thereof along a lower edge thereof permitting the display plaque to be displayed upright on a horizontal surface. Alternatively, or in addition thereto, the board may include an opening in a rear side thereof at an upper edge thereof permitting the display plaque to be hung on a vertical surface.

Preferrably, the nameplate is a brass nameplate secured to the board with push pins, and the photograph is displayed beneath a transparent acrylic panel secured to the board with push pins.

The ornament may include a pair of screws screwed into a rear side thereof. The board may include a pair of keyhole slots formed in a forward side thereof, which receive respective heads of the screws. The ornament is preferably a casket corner ornament.

According to another aspect, a method for memorializing a deceased who is to be buried in a casket comprises displaying the casket containing the deceased therein, the casket having at least one selectively removable ornament, removing the ornament from the casket prior to inserting the casket into a grave, affixing the ornament to a display plaque, and presenting the display plaque and ornament to survivors of the deceased so that the deceased can be remembered by the plaque and ornament.

According to yet another aspect, a method for memorializing a deceased who is to be cremated comprises the steps of displaying a casket containing the deceased therein, the casket having at least one selectively removable ornament, removing the ornament from the casket, cremating the deceased, collecting the remains of the cremated deceased, affixing the ornament to a display plaque, and presenting the remains and display plaque and ornament to survivors of the deceased so that the deceased can be remembered by displaying the plaque and ornament.

The methods may further comprise the step of attaching a nameplate bearing the name of the deceased to the plaque, the step of attaching a photograph of the deceased to the plaque, or both. The ornament is preferably a casket corner ornament.

Various additional features and advantages of the invention will become more readily apparent to those of ordinary skill in the art upon consideration of the following detailed description of the presently preferred embodiment taken in conjunction with the accompanying drawings.

BRIEF DESCRIPTION OF THE DRAWINGS OF THE INVENTION

DETAILED DESCRIPTION OF PREFERRED EMBODIMENTS OF THE INVENTION

Figure 1:
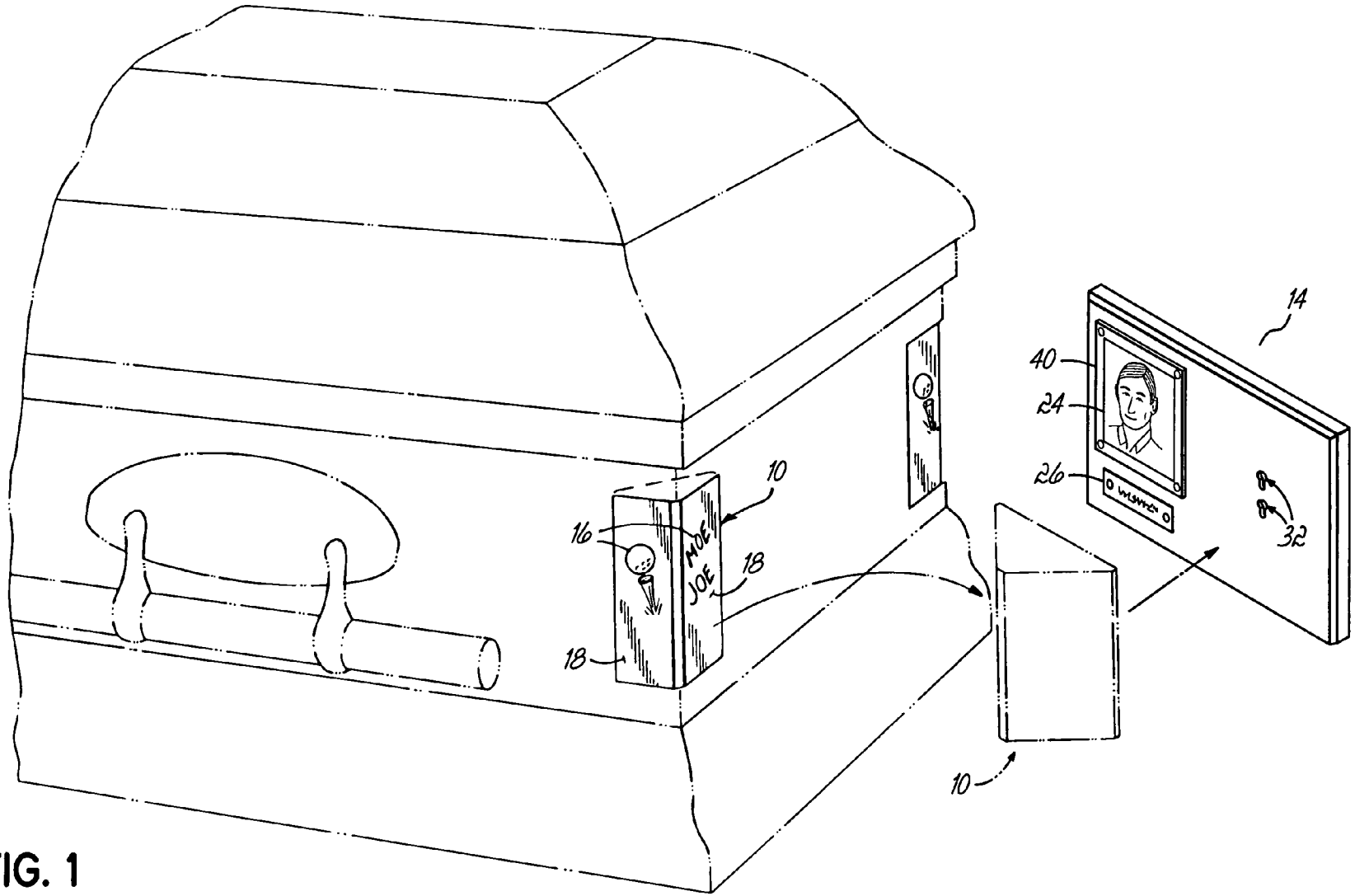
FIG. 1 is a partial perspective view of a casket corner piece attached to a casket and which is removable for placement onto a casket ornament display plaque.

Referring first to FIG. 1, decorative casket hardware or a decorative casket hardware component such as a casket corner piece 10 is shown attached to the corner of a burial or cremation container or casket 12 (shown in phantom). The casket corner piece 10 is selectively removable from the corner of the casket 12. Upon removing the casket corner piece 10 from the casket 12, the casket corner piece may be affixed to a casket ornament display plaque 14 such as the one shown in FIG. 1 constructed in accordance with the principles of the invention. As shown in FIG. 1, the casket corner piece 10 may preferably include personalized graphics 16 such as pictures, names, dates, and the like emblazoned onto the exterior surface 18 of the casket corner piece 10. These personalized graphics 16 are intended to help memorialize the deceased by reminding those who see the casket corner piece 10 of a particular aspect of the deceased's life. For instance, the placement of golf related items on the casket corner piece 10 would be suitable personalized graphics 16 for a deceased who was an avid golfer.

Figure 2:
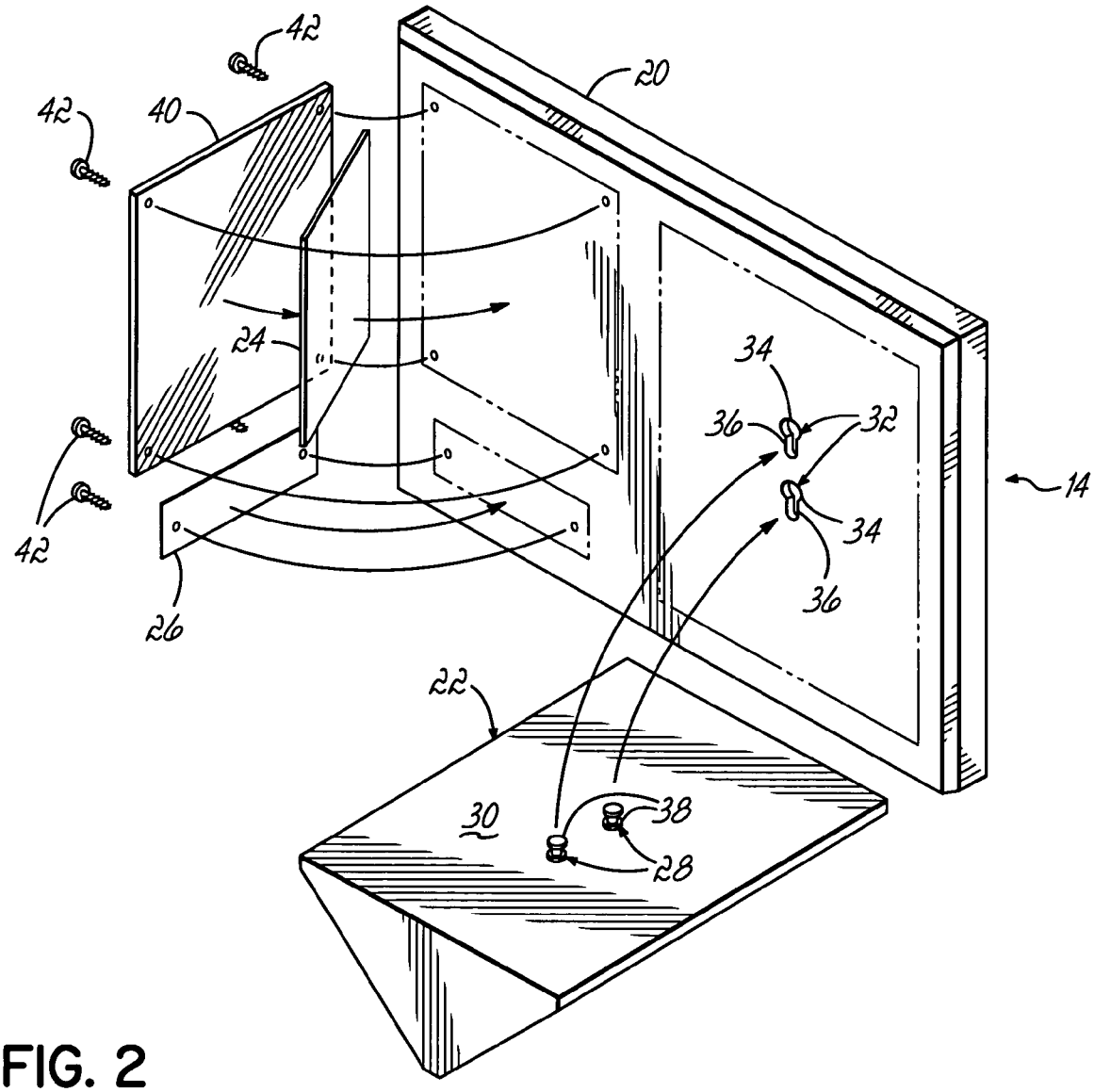
FIG. 2 is a disassembled front perspective view of the casket ornament display plaque.

With reference now to FIG. 2, the casket ornament display plaque 14 is constructed of a generally rectangular board 20 to which is attached a casket ornament 22, for example casket corner ornament 10. Indicia identifying the deceased to be memorialized, such as a photograph 24 and/or a nameplate 26, may also be attached to the board 20. Casket ornament 22 includes a fastener element, for example a pair of shoulder screws 28, 28 screwed into a rear surface 30 of the ornament 22 in a vertically spaced and aligned manner. Board 20 includes a cooperating fastener element, for example a pair of keyhole slots 32, 32 each of which includes a circular portion 34 and a narrower slot portion 36 depending from the circular portion 34. To attach the casket ornament 22 to the board 20 the heads 38, 38 of the screws 28, 28 are passed through the circular portions 34, 34 of the keyhole slots 32, 32. Ornament 22 is then slid downwardly relative to the board 20 such that the heads 38, 38 are captured behind and retained by the narrower slots 36, 36.

Photo 24 may be retained behind a transparent acrylic photograph cover 40 which is attached to the board 20 with four decorative push pins 42. Nameplate 26 is preferably a decorative brass nameplate also attached with a pair of decorative push pins 42. Nameplate 26 may be engraved with, for example, the deceased's name, date of birth, date of death, etc.

Figure 3:
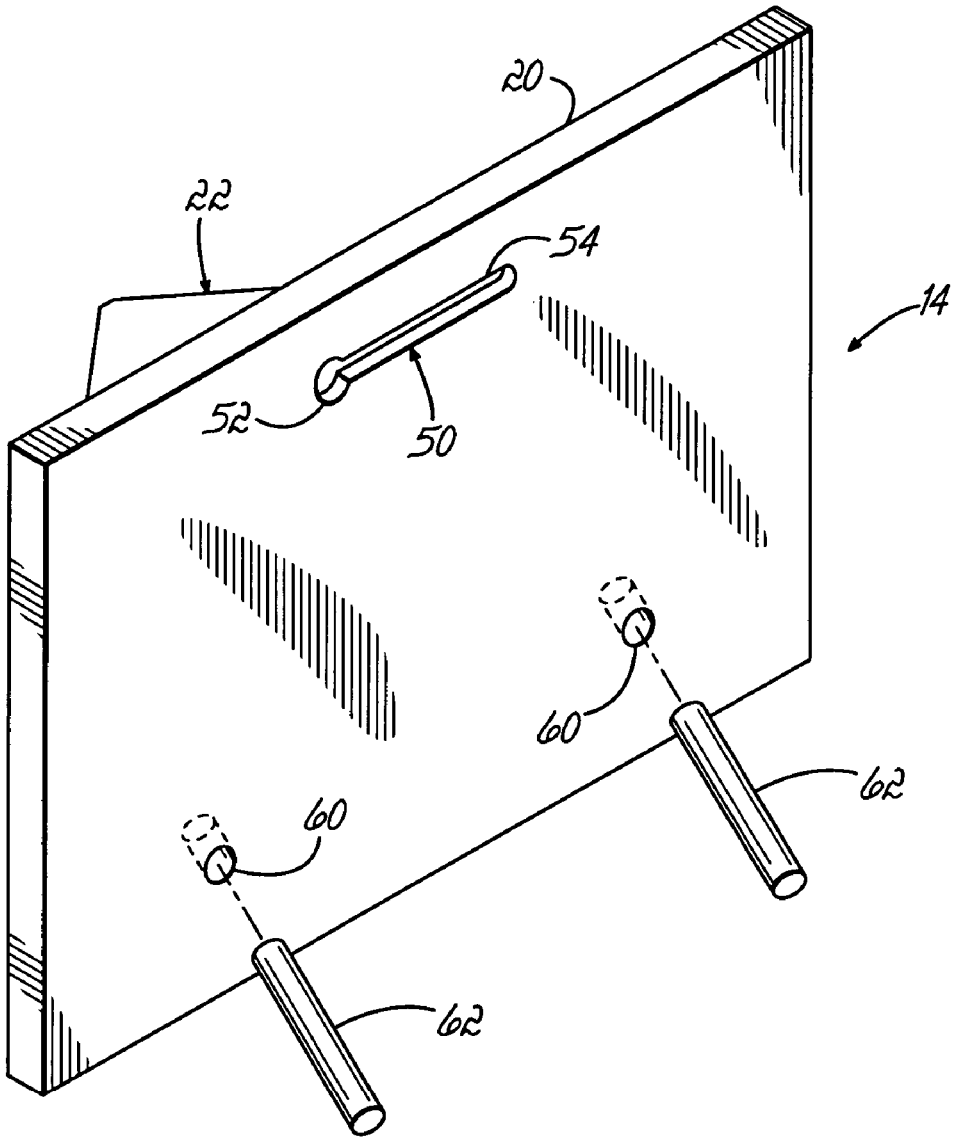
FIG. 3 is a partially disassembled rear perspective view of the casket ornament display plaque.

The casket ornament display plaque 14 may be displayed on either a horizontal surface, for example a table top, or displayed hanging from a vertical surface, for example a wall. Referring now to FIG. 3, the rear side of the board 20, along an upper edge thereof, includes an opening, preferably an elongated keyhole slot 50, including a circular portion 52 and a narrower elongated slot portion 54 extending laterally or widthwise of the board 20 from the circular portion 52. A fastener, such as a screw, may be installed in a wall, and the head thereof may be passed through the circular portion 52 of the keyhole slot 50; then the board 20 may be slid horizontally relative to the screw so as to capture the head of the screw behind the narrower slot portion 54. Alternatively, or in addition thereto, the board 20 includes a pair of spaced bores 60, 60 near a lower edge thereof. These bores 60, 60 accept a pair of dowel pins 62, 62 thus permitting the plaque 14 to be displayed in a generally upright, slightly tilted orientation on a horizontal surface.

The casket ornament display plaque 14 can be made from any suitable structural material. It is contemplated, however, that the casket ornament display plaque 14 will be constructed of furniture grade wood that is suitable for receiving various stains and from which are constructed caskets. For example, a variety of woods could be utilized such as mahogany, cherry, walnut, maple, and oak.

The casket ornament display plaque is suited for presenting to the family members with the personalized casket corner piece 10 at a grave side service much like a flag presentation ceremony during military funerals. Specifically, before the casket is lowered into the grave, the funeral director would remove the casket corner piece 10 from the corner of the casket 12. The funeral director would then secure the casket corner piece 10 to the casket ornament display plaque 14 and present it to the family. Before or after the funeral service, the funeral director or family can place a picture of the deceased into the transparent cover as a way to further memorialize the deceased. The casket ornament display plaque 14 can also be similarly used for memorializing a deceased who is cremated as opposed to being buried. The individual to be cremated may still be viewed in a casket at the funeral home. The casket would be adorned by a casket corner piece 10 during such viewing. After cremation, the funeral director would collect the cremated remains and place them within a cremation urn. In addition, the funeral director will secure the casket corner piece 10 from the casket in which the deceased was displayed to the casket ornament display plaque 14. Thereafter, the funeral director will present the casket ornament display plaque 14 and urn to the family members of the cremated individual.

While the present invention has been illustrated by a description of a preferred embodiment and while this embodiment has been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art. For example, casket ornaments other than corner ornaments could be attached to the display plaque, to include other decorative casket hardware or hardware components such as escutcheons, ears, handle portions, base mold, top mold, and the like. The invention itself should only be defined by the appended claims.

The invention claimed is:

1. A casket ornament display plaque, comprising:

a substantially planar decorative board including a first fastener element;

decorative casket hardware including a second fastener element, said decorative casket hardware attached to said board with said first and second fastener elements; and indicia attached to said board identifying a deceased to be memorialized;

said decorative casket casket hardware having an external decorative design which is substantially identical to casket hardware on a casket which contained the deceased.

2. The casket ornament display plaque of claim 1, wherein said indicia is a nameplate bearing the name of the deceased.

3. The casket ornament display plaque of claim 2, wherein said nameplate is a brass nameplate secured to said board with push pins.

4. The casket ornament display plaque of claim 1, wherein said indicia is a photograph of the deceased.

5. The casket ornament display plaque of claim 4, wherein said photograph is displayed beneath a transparent acrylic panel secured to said board with push pins.

6. The casket ornament display plaque of claim 1, wherein said indicia is a nameplate bearing the name of the deceased and a photograph of the deceased.

7. The casket ornament display plaque of claim 1, said board including a pair of dowels installed in openings in a rear side thereof along a lower edge thereof permitting said display plaque to be displayed upright on a horizontal surface.

8. The casket ornament display plaque of claim 1, said board including an opening in a rear side thereof at an upper edge thereof permitting said display plaque to be hung on a vertical surface.

9. The casket ornament display plaque of claim 1 wherein said decorative casket hardware attached to said board was removed from the casket which contained the deceased.

10. A method for memorializing a deceased who is to be buried in a casket, the steps comprising:

displaying the casket containing the deceased therein, the casket having at least one decorative hardware component, having an external decorative design, secured to the casket;

affixing decorative hardware component, having an external decorative design substantially identical to the at least one decorative hardware component on the casket which contained the deceased, to a substantially planar display plaque; and presenting the display plaque and the decorative hardware component to survivors of the deceased so that the deceased can be remembered by displaying the plaque and the decorative hardware component.

11. The method of claim 10, further comprising the step of attaching a nameplate bearing the name of the deceased to the plaque.

12. The method of claim 10, further comprising the step of attaching a photograph of the deceased to the plaque.

13. The method of claim 10, further comprising the steps of attaching a nameplate bearing the name of the deceased to the plaque and attaching a photograph of the deceased to the plaque.

14. The method of claim 10, wherein the decorative hardware component is a casket corner ornament.

15. The method of claim 10, wherein the decorative hardware component affixed to the display plaque was removed from the casket which contained the deceased.

16. A method for memorializing a deceased who is to be cremated, the steps comprising:

displaying a casket containing the deceased therein, the casket having at least one decorative hardware component having an external decorative design;

cremating the deceased;

collecting the remains of the cremated deceased;

affixing a decorative hardware component, having an external decorative design substantially identical to the at least one decorative hardware component on the casket which contained the deceased, to a substantially planar display plaque; and presenting the remains and the display plaque and the decorative hardware component to survivors of the deceased so that the deceased can be remembered by displaying the plaque and the decorative hardware component.

17. The method of claim 16, further comprising the step of attaching a nameplate bearing the name of the deceased to the plaque.

18. The method of claim 16, further comprising the step of attaching a photograph of the deceased to the plaque.

19. The method of claim 16, further comprising the steps of attaching a nameplate bearing the name of the deceased to the plaque and attaching a photograph of the deceased to the plaque.

20. The method of claim 16, wherein the decorative hardware component is a casket corner ornament.

21. The method of claim 16, wherein the decorative hardware component affixed to the display plaque was removed from the casket which contained the deceased.

22. A method of memorializing a deceased comprising:

displaying the deceased in a casket having at least one decorative hardware component having an exterior decorative design;

affixing a decorative hardware component having an external decorative design substantially identical to the at least one decorative hardware component on the casket which contained the deceased, to a substantially planar display plaque; and presenting the display plaque and the decorative hardware component to survivors of the deceased.

23. The method of claim 22, wherein the decorative hardware component affixed to the display plaque was removed from the casket which contained the deceased.

* * * * *

UNITED STATES PATENT AND TRADEMARK OFFICE

CERTIFICATE OF CORRECTION

PATENT NO. : 7,210,204 B2
APPLICATION NO. : 11/110548
DATED : May 1, 2007
INVENTOR(S) : Brian K. Groemminger and Christopher M. Wessel It is certified that error appears in the above-identified patent and that said Letters Patent is hereby corrected as shown below:

Col. 5, line 14, Claim 10 reads: "affixing decorative hardware component, having an exter-"; it should read: -- affixing a decorative hardware component, having an exter- --.

Col. 6, line 31, Claim 22 reads: "affixing a decorative hardware component having an"; it should read: -- affixing a decorative hardware component, having an --.

Signed and Sealed this

Thirtieth Day of September, 2008

JON W. DUDAS
*Director of the United States Patent and Trademark Office*